United States Patent [19]

Andrews

[11] 3,945,092

[45] Mar. 23, 1976

[54] CABLE KNOT CINCHER

[76] Inventor: Cecil L. Andrews, P.O. Box 214, Burney, Calif. 96013

[22] Filed: July 15, 1974

[21] Appl. No.: 488,710

[52] U.S. Cl. ..... 24/248 L; 30/241; 83/452; 214/94; 269/128

[51] Int. Cl.[2]. A44B 21/00; B26B 13/00; B25B 1/04

[58] Field of Search ..... 289/2; 24/249 SL, 249 LS, 24/249 FP, 249 LL, 248 B, 248 L, 248 CR, 263 C, 263 LL, 263 LS, 263 DL, 241 PP; 254/190, 83; 242/149; 30/124, 131, 231, 241, 290; 140/51, 101, 139; 83/452; 269/321 N, 128, 268; 214/94

[56] References Cited

UNITED STATES PATENTS

| | | | |
|---|---|---|---|
| 1,202,607 | 10/1916 | Sweeny | 269/268 X |
| 2,024,112 | 12/1935 | Phillis | 269/128 X |
| 2,217,072 | 10/1940 | Nixon | 24/263 DL UX |
| 2,286,289 | 6/1942 | Lyshaug | 30/290 |
| 2,460,079 | 1/1949 | Ferree | 269/128 |
| 2,547,601 | 4/1951 | Scheirer | 214/94 UX |
| 2,615,238 | 10/1952 | Highwood | 269/268 X |
| 3,264,701 | 8/1966 | McClay | 24/249 LL |
| 3,450,359 | 6/1969 | Draving et al. | 242/149 X |

FOREIGN PATENTS OR APPLICATIONS

| | | | |
|---|---|---|---|
| 844,149 | 8/1960 | United Kingdom | 30/241 |

*Primary Examiner*—Donald A. Griffin
*Attorney, Agent, or Firm*—Klarquist, Sparkman, Campbell, Leigh, Hall & Whinston

[57] ABSTRACT

A knot cincher mounted on a skidder has a quick-releasable cable clamp for holding an end portion of a stiff cable from a winch having a loose knot between the clamp and the winch. The winch is operated to tighten the cable to cinch the knot. A cable shear adjacent the clamp can be actuated to trim the end of the cable if necessary. A guard mounted adjacent the clamp protects the clamp.

3 Claims, 5 Drawing Figures

CABLE KNOT CINCHER

DESCRIPTION

This invention relates to a cable knot cincher, and has for an object thereof the provision of a cable knot cincher for tightening a knot in a stiff cable from a winch of a skidder.

Another object of the invention is to provide a knot cincher having a quick-releasable clamp.

A further object of the invention is to provide a knot cincher having a clamp and a shear mounted adjacent thereto.

Another object of the invention is to provide a knot cincher having a V-groove and a threaded presser mounted on an arm which may be swung from an open position to a closed position and latched in the closed position.

Figure 5:
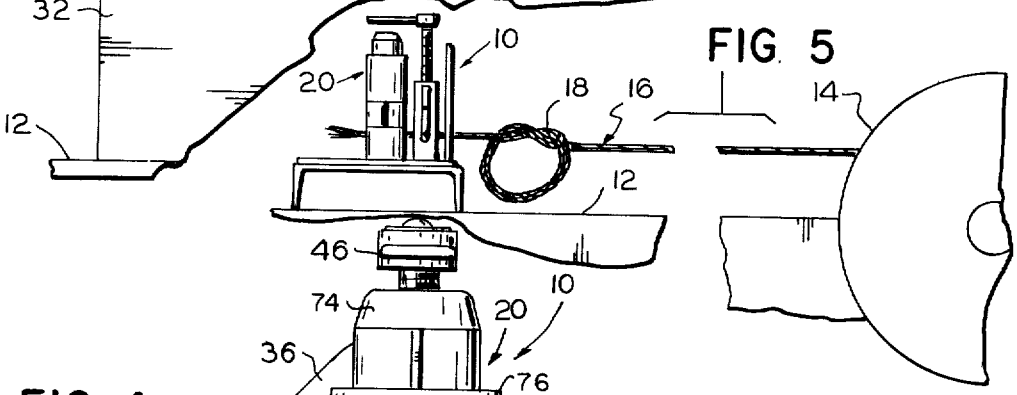
FIG. 5 is a fragmentary, side elevation view of the knot cincher of FIG. 1 mounted on a skidder.
Figure 4:
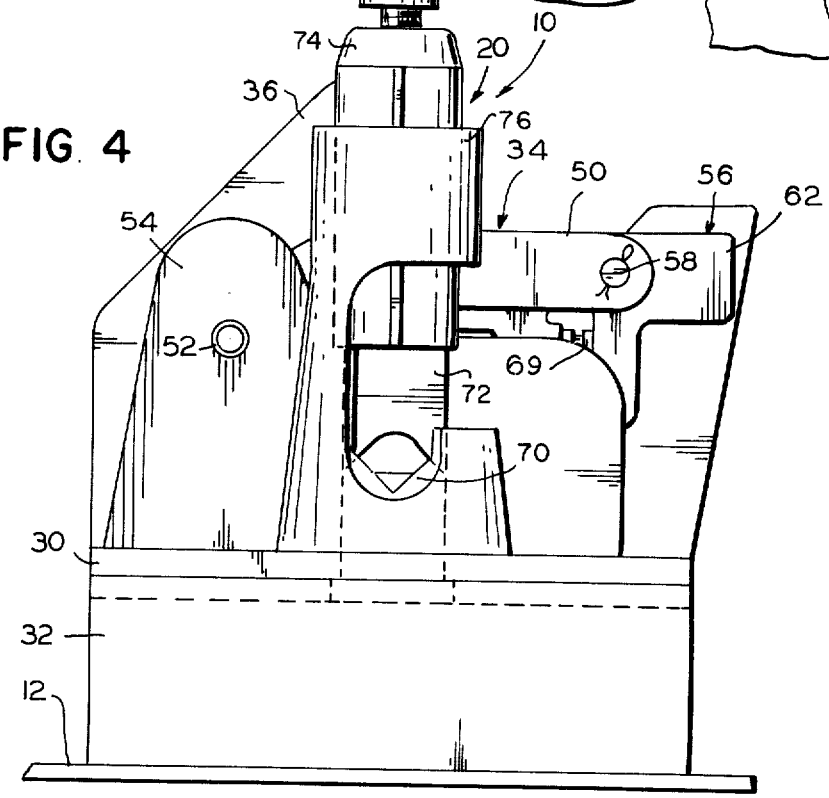
FIG. 4 is a rear elevation view of the knot cincher of FIG. 1.

Referring now in detail to the drawings, there is shown therein a knot cincher 10 forming one specific embodiment of the invention and mounted on a skidder 12 (FIG. 5). When a powered winch 14 of the skidder is operated to tighten a stiff wire cable 16 having an overhand knot 18 hear its free end, which is clamped by the cincher, the knot is tightened. The knot then will not come loose and serves to prevent butt hooks on the cable from coming off the cable when the skidder is pulling turns of logs secured to the butt hooks. A shear 20 is positioned on the cincher for shearing off the end portion of the cable if it should be frayed.

Figure 1:
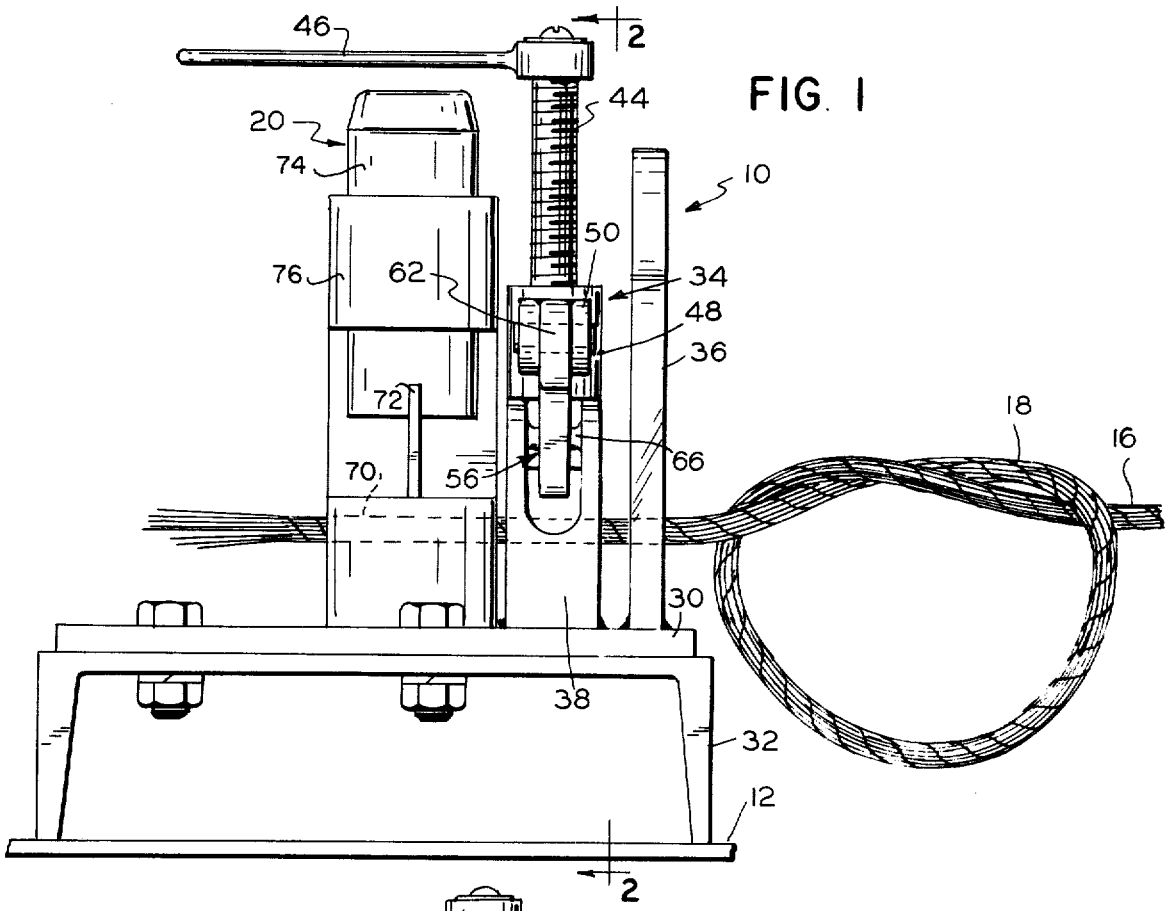
FIG. 1 is a side elevation view of a knot cincher forming one specific embodiment of the invention.
Figure 2:
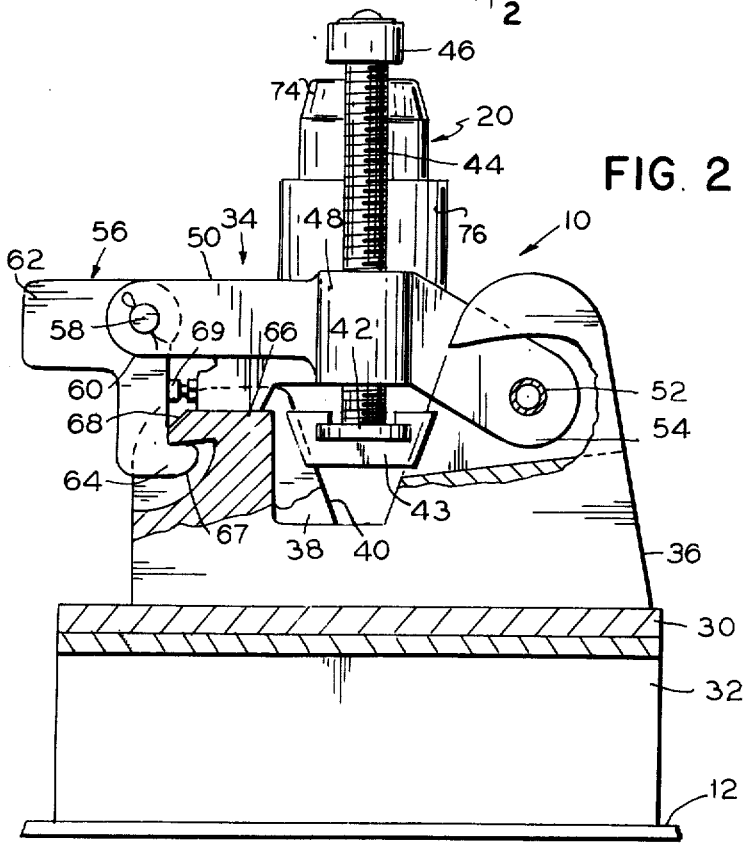
FIG. 2 is a fragmentary, front elevation view of the knot cincher of FIG. 1.
Figure 3:
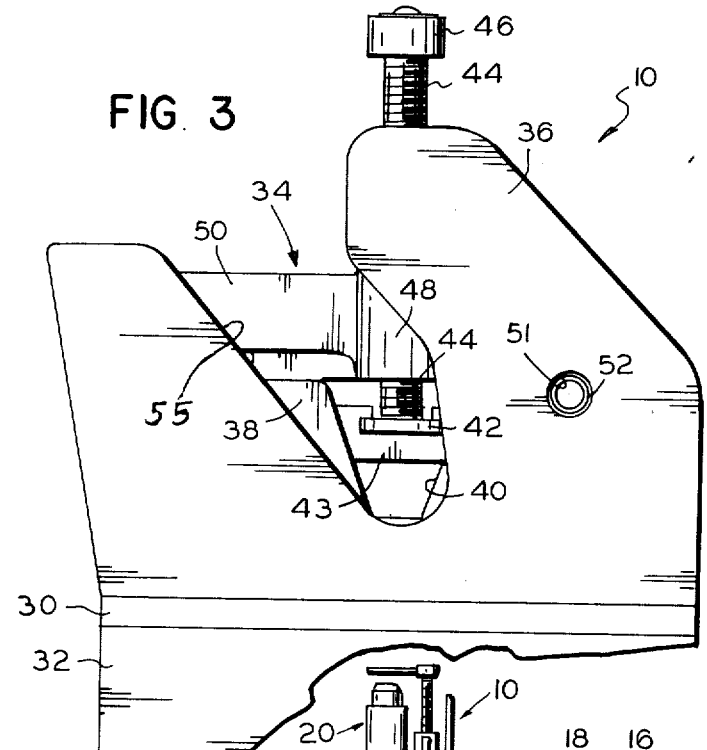
FIG. 3 is a front elevation view of the knot cincher of FIG. 1.

The cincher 10 includes a base 30 (FIG. 1) bolted to a channel 32 welded to the skidder. A clamp 34 is mounted between the shear 20 and a notched guard 36. Heavy plates 38 define a lower jaw. The plates 38 are welded to the base and have two spaced aligned V-shaped notches 40 defining V-shaped jaw portions. A truncated triangular plate 43 has a T-shaped slot receiving a disc 42 and forming an upper jaw. The plate 43 extends into the spaces between the plates 38 at both sides of the notches which guide the jaw 43 and keep it on the disc 42. The jaw 43 may be moved downwardly by a screw 44 to clamp the cable against the sides of the notches 40. The screw is turned by handle 46 and is threaded through a tapped bore 48 in an arm 50 mounted pivotally by a pin 52 between a clevis portion 54 of the plates 38. A notch 55 in the guard 36 slopes downwardly to alignment with the opening between the jaws. A quick-release latching hook 56 is mounted pivotally on a pin 58 carried by a clevis-like portion 60 at the free end of the arm 50. The hook 56 has a short handle 62 and a hook portion 64 adapted to hook under an upwardly sloping notched catch 66. The hook has a camming end portion 67 adapted to engage a sloping camming, upper surface 68 of the catch to permit the hook to clear the catch when the arm is dropped to closed position. An adjustment screw 69 in a lug of the arm limits counter-clockwise, as viewed in FIG. 2, pivotal movement of the hook relative to the arm 50 so that the camming end portion of the hook engages the upper surface 68 of the catch and is cammed to the left to clear the catch and then be moved thereunder by gravity. The lug engages the top of the catch to limit downward movement of the arm beyond its closed position.

The shear 20 includes a V-shaped anvil portion 70 with which a V-shaped blade 72 cooperates to shear off the cable end when a plunger 74 is struck with a maul. The plunger is splined to a tubular guide 76.

When a new cinched knot is needed, with the arm 50 swung back to its open position, and the loose knot 18 formed, the end portion of the cable is moved laterally through the notch of the guard 36 and laid in the notched or V-shaped jaw portions 40, the end portion of the cable being pushed through the shear if it is desired to trim off the end. Then the arm 50 is swung to its closed position and the hook 56 latches the arm in its closed position. The screw 44 then is turned to securely clamp the cable between the jaw portions 40 and the jaw 43. The winch 14 then is driven to tighten the cable which cinches the knot 18. Then, if desired, the shear is actuated to cut off the end portion of the cable, after which the jaw 43 is loosened, and the handle of the hook 50 is pulled up to unlatch the hook and swing the arm to its open position. The rope then is pulled out of the cincher. This, of course, may be done even without swinging the arm to its open position.

What is claimed is:

1. A cable clamp adapted to be used in conjunction with a powered winch on a skidder to cinch a knot in a cable comprising:

a base having a catch, an upwardly facing first jaw fixed on the base, arm means swingable on the base between an open position clearing the first jaw to permit a cable to be moved laterally onto the first jaw and a closed position extending over the first jaw and having a lug, a screw mounted on the arm, a second jaw carried by the screw, a catch carried by the base and having a camming portion, a latch member having a hook portion and pivotally carried by the arm means, and an adjustment screw carried by the lug and adapted to engage the latch member to limit movement of the hook portion of the latch member so that a camming end portion of the hook engages the upper surface of the catch and is cammed to clear the catch and then be moved thereunder by gravity, the lug engaging the top of the catch to limit downward movement of the arm beyond its closed position.

2. In combination of a knot cincher and a logging skidder having a winch and a cable secured to the winch, the knot cincher including a base secured rigidly to the skidder, an upwardly facing first jaw fixed on the base, arm means swingable on the base between an open position clearing the first jaw to permit a cable to be moved laterally onto the first jaw and a closed position extending over the first jaw, a screw mounted on the arm, a second jaw carried by the screw, quick-release latch means for locking the arm in its closed position, and a notched guard mounted on the base in front of the jaws and adapted to guide the cable into the first jaw.

3. The knot cincher of claim 2 including a shear mounted on the base to the rear of the jaws and aligned with the jaws, the guard serving to guide the cable into the shear and the jaws.

* * * * *